US006234884B1

(12) United States Patent
Inaba

(10) Patent No.: US 6,234,884 B1
(45) Date of Patent: May 22, 2001

(54) SEMICONDUCTOR WAFER POLISHING DEVICE FOR REMOVING A SURFACE UNEVENNESS OF A SEMICONDUCTOR SUBSTRATE

(75) Inventor: Shoichi Inaba, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/251,438

(22) Filed: Feb. 17, 1999

(30) Foreign Application Priority Data

Feb. 17, 1998 (JP) ..... 10-34465

(51) Int. Cl.[7] ..... B24B 5/00
(52) U.S. Cl. ..... 451/288; 451/56
(58) Field of Search ..... 451/41, 56, 443, 451/287, 288, 286

(56) References Cited

U.S. PATENT DOCUMENTS 5,216,843 * 6/1993 Breivogel et al. ..... 51/131.1
5,547,417 * 8/1996 Breivogel et al. ..... 451/58
5,611,943 * 3/1997 Cadien et al. ..... 216/88
5,637,031 * 6/1997 Chen ..... 451/41
5,664,990 * 9/1997 Adams et al. ..... 451/60
5,672,095 * 9/1997 Morimoto et al. ..... 451/41
5,755,614 * 5/1998 Adams et al. ..... 451/60
5,851,138 * 12/1998 Hempel, Jr. ..... 451/56
5,857,899 * 1/1999 Volodarsky et al. ..... 451/72
5,893,753 * 4/1999 Hempel, Jr. ..... 438/691
6,110,025 * 8/2000 Williams et al. ..... 451/286

* cited by examiner

*Primary Examiner*—Lowell A. Larson
(74) *Attorney, Agent, or Firm*—Foley & Lardner

(57) ABSTRACT

A surface of a semiconductor wafer is polished by a polishing pad provided on a rotary polishing table while a polishing slurry is supplied onto a surface of the polishing pad. A surface condition of the polishing pad is regulated by a polishing pad surface mending unit which is provided on an upstream of the wafer in a rotating direction of said polishing table.

5 Claims, 9 Drawing Sheets

SEMICONDUCTOR WAFER POLISHING DEVICE FOR REMOVING A SURFACE UNEVENNESS OF A SEMICONDUCTOR SUBSTRATE

BACKGROUND OF THE INVENTION

1. Field of the Invention

The present invention relates to a wafer polishing device and, more particularly, to a wafer polishing device for removing a surface unevenness of a semiconductor substrate.

2. Description of the Related Art

FIG. 4 shows a conventional wafer polishing device. The polishing device includes a rotatable polishing table 1, a polishing pad 4 provided on the polishing table 1 and a carrier head 8 for supporting a semiconductor substrate 2, that is, a wafer 2, to be polished. The polishing apparatus further includes a pressing mechanism 9 for pressing the wafer 2 together with the carrier head 8 to the polishing pad 4 and a spindle 10 for rotating the wafer 2 with the carrier head 8 on the polishing pad 4. A polishing slurry 5 is supplied onto a surface of the polishing pad 4 by means of a pump, etc from a polishing slurry nozzle 11.

The wafer 2 is pressed by the pressing mechanism 9 to the rotating polishing pad 4 through the spindle 10 and the carrier head 8 so that the wafer 2 is polished by the polishing pad 4. For example, the wafer contains a plurality of semiconductor layers, which are polished by CMP (chemical mechanical polishing) method to flatten a surface of the wafer including them.

The wafer polishing device further includes a retainer ring 3 for holding the wafer on the polishing pad 4. The retainer ring 3 may take in the form of non-contact type retainer shown in FIG. 5 or in the form of contact type retainer 3 shown in FIG. 6. The retainer ring 3 shown in FIG. 5 is used only for retaining the wafer 2 in a predetermined position on the polishing pad 4 without contacting with a surface of the polishing pad 4 so that the slurry 5 can be easily supplied into between the polishing pad 4 and the wafer 2. However, when such retainer ring is used, load is concentrated between an edge portion of the wafer 2 and the polishing pad 4. Therefore, the edge portion of the wafer 2 is polished at higher speed than the surface except the edge portion of the wafer 2 so that the peripheral portion of the wafer 2 is abnormally polished as shown in FIG. 7. Therefore, the flatness of the outer peripheral portion of the wafer 2 is degraded as shown in FIG. 9, resulting in the yield of wafer being reduced.

In order to solve the problem caused by the non-contact type retainer ring shown in FIG. 5, the retainer ring 3 shown in FIG. 6 is used. This retainer ring 3 is always in contact with the surface of the polishing pad 4. According to the retainer ring 3 shown in FIG. 6, the load to be applied concentrically between the polishing pad 4 and the wafer 2 is dispersed and the load point is moved outward of the retainer ring 3. Therefore, the polishing speed profile at the edge portion of the wafer is improved as shown in FIG. 8.

However, there is a problem when the retainer ring 3 shown in FIG. 6 is used. That is, in the wafer polishing device using the retainer ring 3 of the contact type, the supply of slurry into between the wafer 2 and the polishing pad 4 becomes short since the polishing pad 4 is in contact with the retainer ring 3. Further, since the slurry 5 already supplied tends to stay within the retainer ring 3, the supply of new slurry into the retainer ring 3 is blocked, causing the polishing speed for the surface of the wafer 2 to be varied. Therefore, the polishing profile in the edge portion of the wafer is varied.

SUMMARY OF THE INVENTION

An object of the present invention is to provide a semiconductor substrate polishing device capable of realizing a good surface flatness of semiconductor substrate and improving the yield of semiconductor substrate to thereby improve the productivity of semiconductor substrate.

As a result of investigations conducted by the inventor of this invention in order to achieve the above objects, it has been found that the abnormal polishing of the edge portion of the wafer is caused mainly by a deformation of a surface of the polishing pad at an upstream side in a rotating direction of the polishing table and that such abnormal polishing can be improved enough even without providing the contact type retainer ring in a downstream side of the wafer. The term "upstream side" means a region in which the polishing table at a cross point of a rotation line indicative of the rotating direction of the polishing table and the peripheral edge of the wafer moves inward of the wafer. The term "downstream side" means a region in which the polishing table at a cross point of the rotation line and the peripheral edge of the wafer moves outward of the wafer.

The wafer polishing device according to the present invention comprises: a rotatable polishing table; a polishing pad provided on the polishing table for polishing a wafer; a polishing slurry supply unit for supplying a polishing slurry onto a surface of the polishing pad; and a polishing pad surface mending unit for regulating a surface condition of the polishing pad while being in slide contact with the polishing pad, the polishing pad surface mending unit positioned on an upstream side of the wafer in a rotating direction of the polishing table.

In the wafer polishing device according to the present invention, the polishing pad surface mending unit is arranged in the region of the upstream side of the wafer and there is no contact ring provided in the region of the downstream side of the wafer. Therefore, the flow of slurry is improved and the uniformity of polishing speed of the wafer can be improved.

That is, the polishing pad surface mending unit functions to shift a rebound deformation of the polishing pad from the wafer edge side of the mending unit toward the edge side of the mending unit opposite to the wafer edge side of the mending unit. Further, since the polishing pad surface mending unit is positioned at the upstream side, the wafer is entirely not covered by the polishing pad surface mending unit, so that the flow of polishing slurry is not blocked by the polishing pad surface mending unit.

In the wafer polishing device of the present invention, it is preferable that the polishing pad surface mending unit surrounds almost all of the peripheral area of the wafer on the upstream side.

Further, in the wafer polishing device of the present invention, it is preferable that a peripheral area of the wafer surrounded by the polishing pad surface mending unit is about 30% to 50% of a whole periphery of the wafer.

When the peripheral area of the wafer surrounded by the polishing pad surface mending unit is smaller than about 30% of the whole periphery of the wafer, the function of the polishing pad surface mending unit to dispersing the local load which applied to the periphery of the wafer becomes insufficient, so that the surface condition at the peripheral portion of the wafer is deformed.

When the peripheral area of the wafer surrounded by the polishing pad surface mending unit exceeds about 50% of the whole periphery of the wafer, the wafer is covered by the polishing pad surface mending unit even in the downstream side of the wafer in the rotating direction of the polishing table, so that the flow of slurry is blocked.

Further, in the wafer polishing device of the present invention, it is preferable that the polishing slurry supply unit is set at a peripheral region of the wafer which is not surrounded by the polishing pad surface mending unit. The supply of polishing slurry is not disturbed by the polishing pad surface mending unit.

In this case, it is enough that the polishing slurry supply unit supplies the polishing slurry to an area which is in the vicinity of a border portion between the peripheral area of the wafer surrounded by the polishing pad surface mending unit and the other peripheral area of the wafer and where the wafer moves from the other peripheral area toward the peripheral area of the wafer surrounded by the polishing pad surface mending unit. In such case, a flow of slurry is formed by the movement of the wafer and the slurry can be supplied efficiently.

BRIEF DESCRIPTION OF THE DRAWINGS

The above and other objects, advantages and features of the present invention will be apparent from the following description taken in conjunction with the accompanying drawings, in which.

DETAILED DESCRIPTION OF THE PREFERRED EMBODIMENTS

Figure 1:
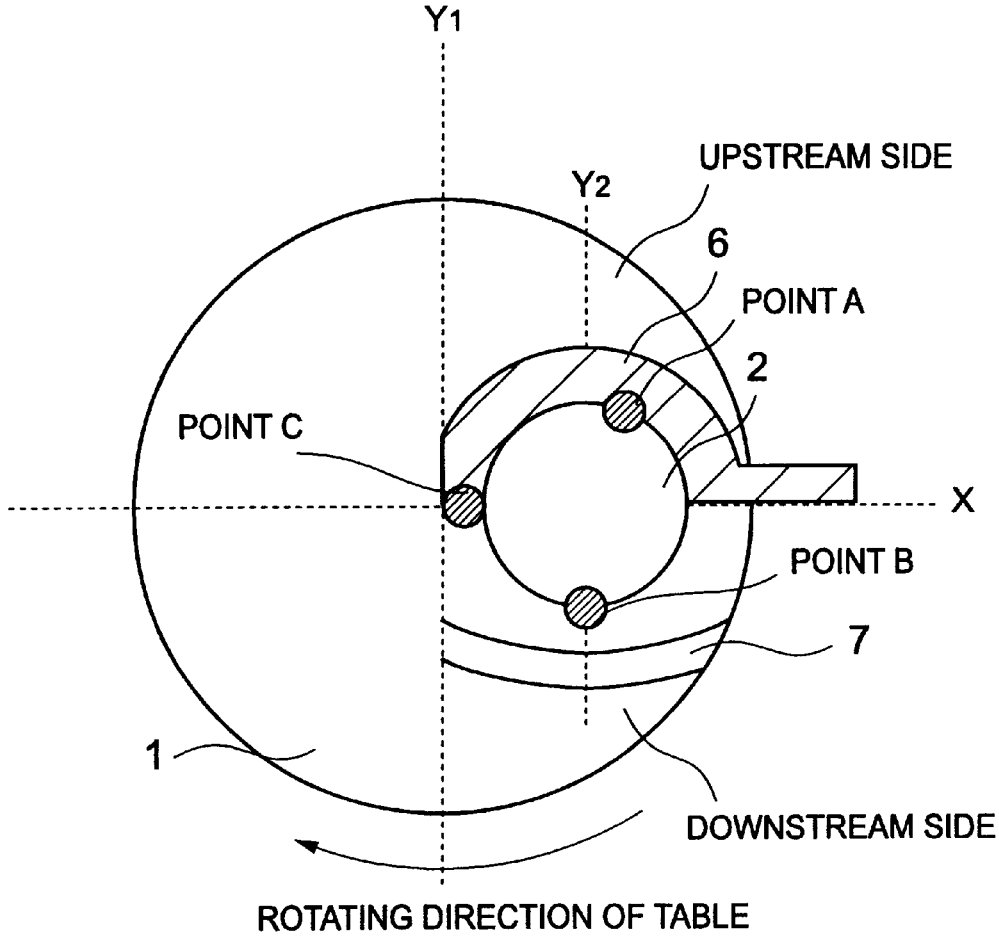
FIG. 1 is a schematic plan view of a wafer polishing device according to the present invention.
Figure 2:
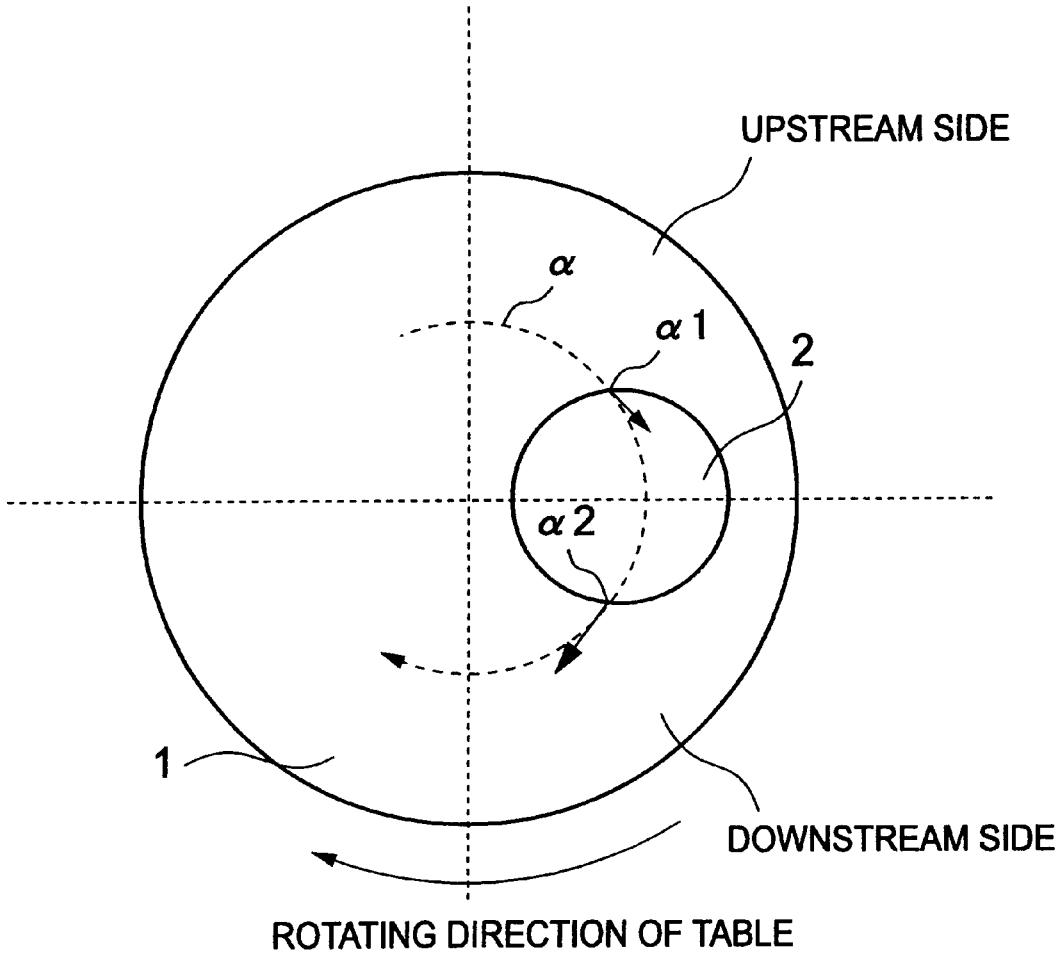
FIG. 2 is a plan view of the wafer polishing device for showing a relationship between a wafer and a polishing table according to the present invention.
Figure 3:
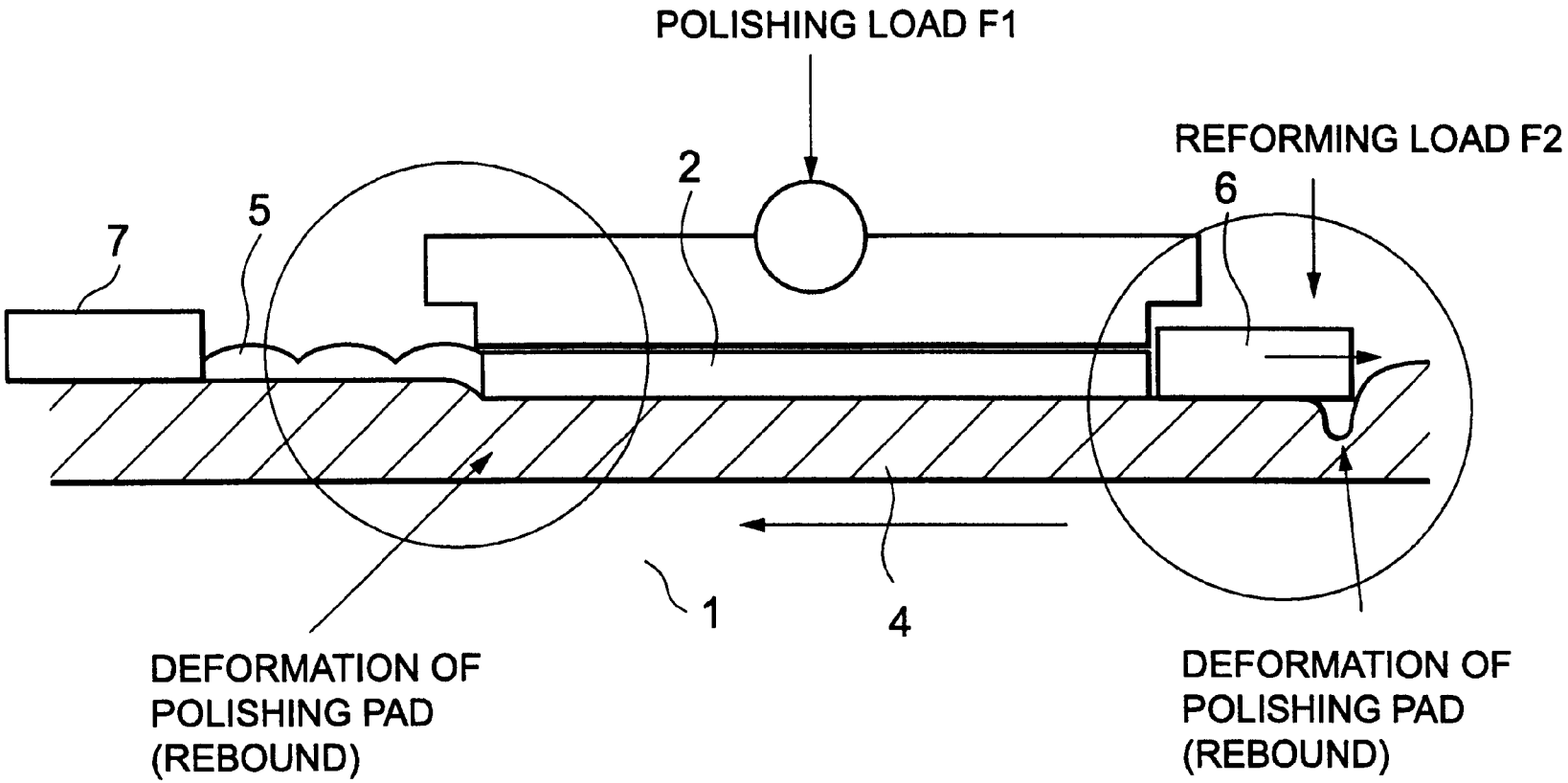
FIG. 3 is a cross sectional view of the wafer polishing device taken along a line Y2 in FIG. 1.

FIGS. 1–3 illustrate the present invention. As shown in FIG. 1, the wafer polishing device is provided with a mending unit 6 of contact type on an upstream side of a rotating direction of a polishing table 1, that is, on a point A. As shown in FIG. 2, the term "upstream side" means a region in which the polishing table 1 at a cross point al of a rotation line α of the polishing table 1 and a peripheral edge of the wafer 2 moves inward of the wafer 2. The term "downstream side" means a region in which the polishing table 1 at a cross point α2 of the rotation line α and the peripheral edge of the wafer 2 moves outward of the wafer 2. The wafer 2 rotates in the same direction with the table 1. That is, the table 1 and the wafer 2 rotate in a clockwise direction on FIG. 1.

Further, according to the present invention, a slurry supply nozzle (not shown) is provided at a point C shown in FIG. 1. The slurry supplying nozzle at the point C is positioned at a peripheral area of the wafer 2, which is not surrounded by the mending unit 6, except a peripheral area of the wafer 2 surrounded by the mending unit 6 for pressing the wafer 2 to the polishing pad 4. Therefore, the supply of slurry is not blocked by the mending unit 6.

The point C is set such that the following conditions are satisfied:

(1) The point C is in the vicinity of a border area between the peripheral portion of the wafer 2 surrounded by the mending unit 6 and a peripheral portion of the wafer 2, which is not surrounded by the mending unit 6.

(2) The point C is in a region in which the wafer 2 rotates from the peripheral region of the wafer which is not surrounded by the mending unit 6 toward the peripheral region of the wafer 2 which is surrounded by the mending unit 6.

With the point C being set under these conditions, a flow of slurry is formed when the wafer 2 rotates, resulting in an efficient supply of slurry.

Further, in order to efficiently take the polishing slurry in between the wafer and the polishing pad, a slurry trap 7 is provided on the downstream side of the wafer in the rotating direction of the polishing pad.

Now, the wafer polishing method according to the present invention will be described.

Figure 4:
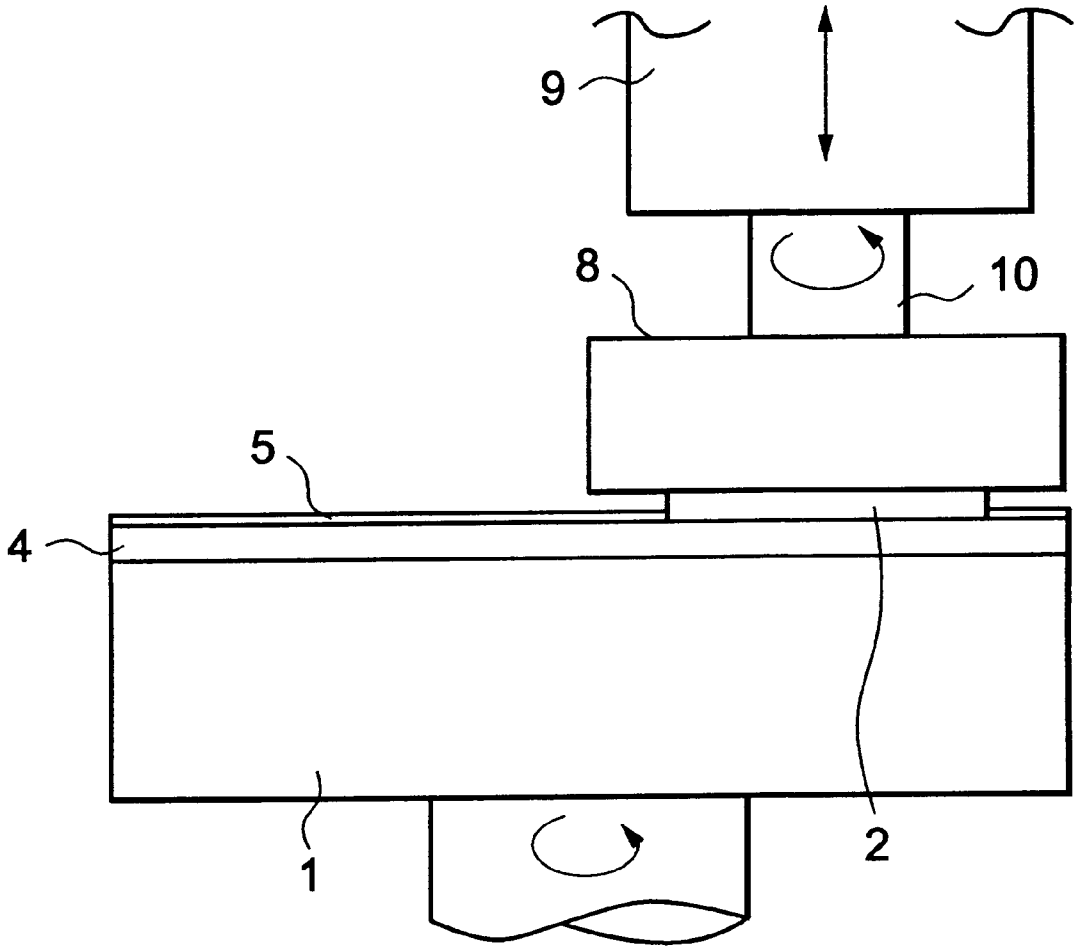
FIG. 4 is a schematic side view of a conventional wafer polishing device.
Figure 5:
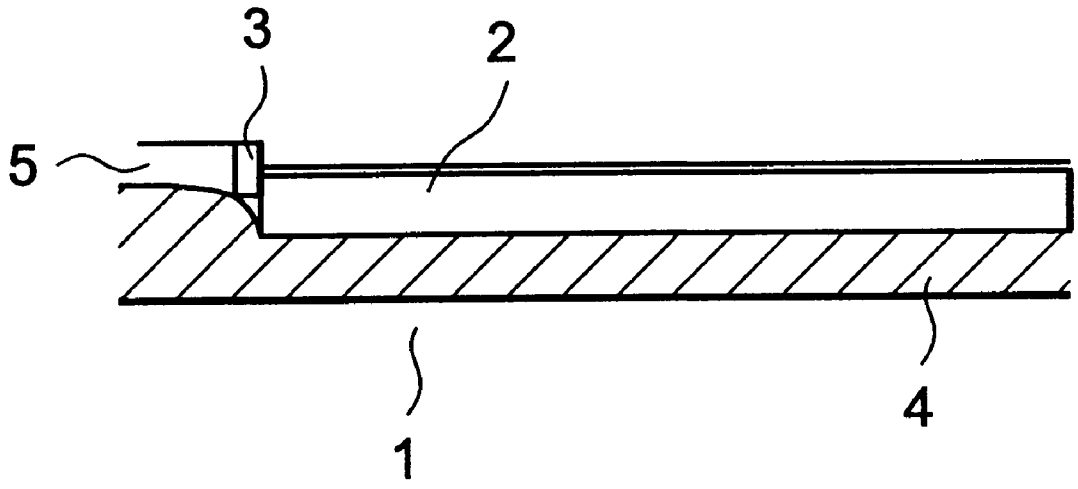
FIG. 5 is a conceptional view showing a relationship between a wafer and a polishing pad according to a conventional wafer polishing method.
Figure 6:
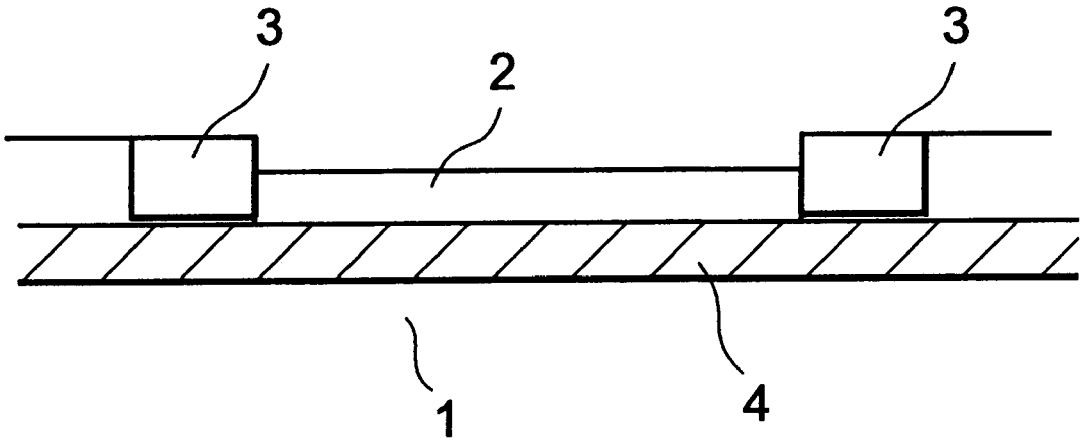
FIG. 6 is a conceptional view showing a relationship between a wafer and a polishing pad according to another conventional wafer polishing method.
Figure 7:
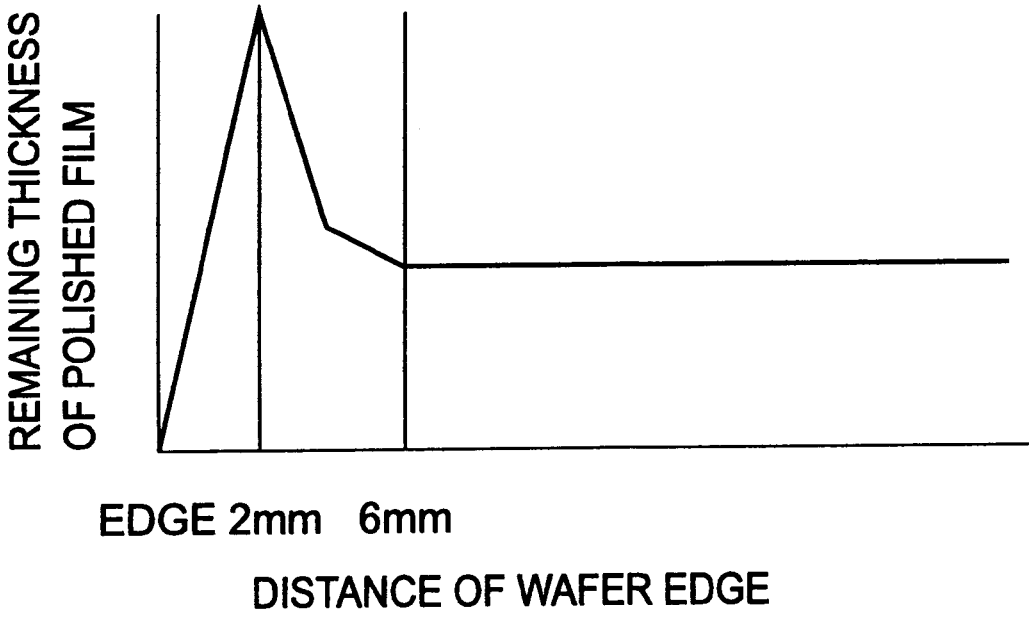
FIG. 7 shows a profile of a wafer polished by the conventional polishing method using a non-contact type retainer ring shown by FIG. 5.
Figure 8:
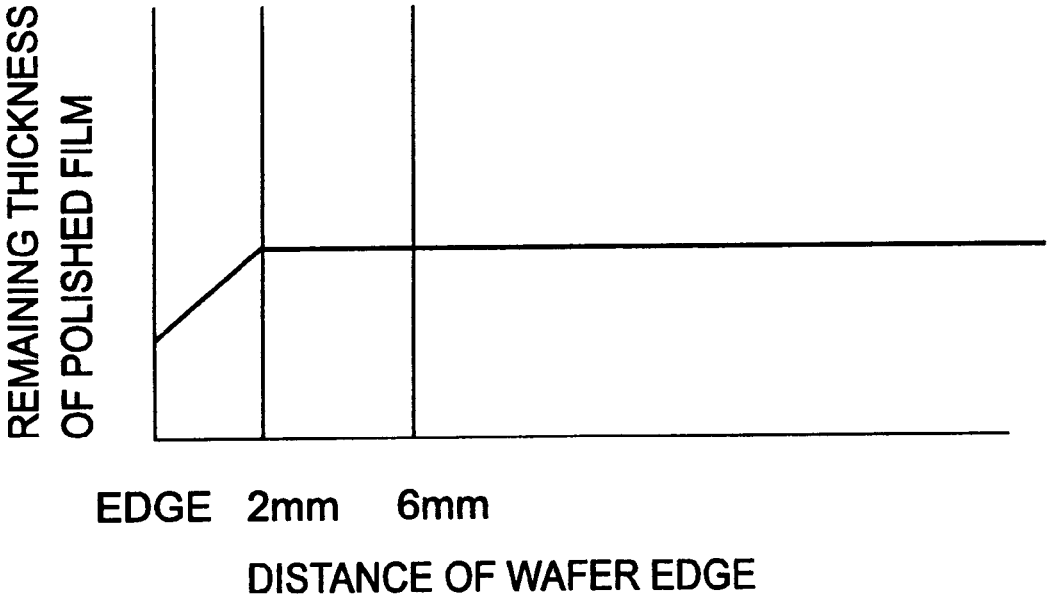
FIG. 8 shows a profile of a wafer polished by the conventional polishing method using a contact type retainer ring shown by FIG. 6.

The rotary polishing table 1 of the polishing device shown in FIG. 4 is rotated by a drive source (not shown) to rotate the polishing pad 4. On the other hand, the wafer 2 is pressed by the pressing mechanism 9 to the polishing pad 4 through the carrier head 8 for retaining the wafer 2. The wafer 2 rotates on the polishing pad 4 together with the carrier head 8 by the spindle 10. The wafer 2 rotates in the same direction with table 1. The polishing slurry 5 is supplied onto the polishing pad 4 by using a pump, etc.

Figure 9:
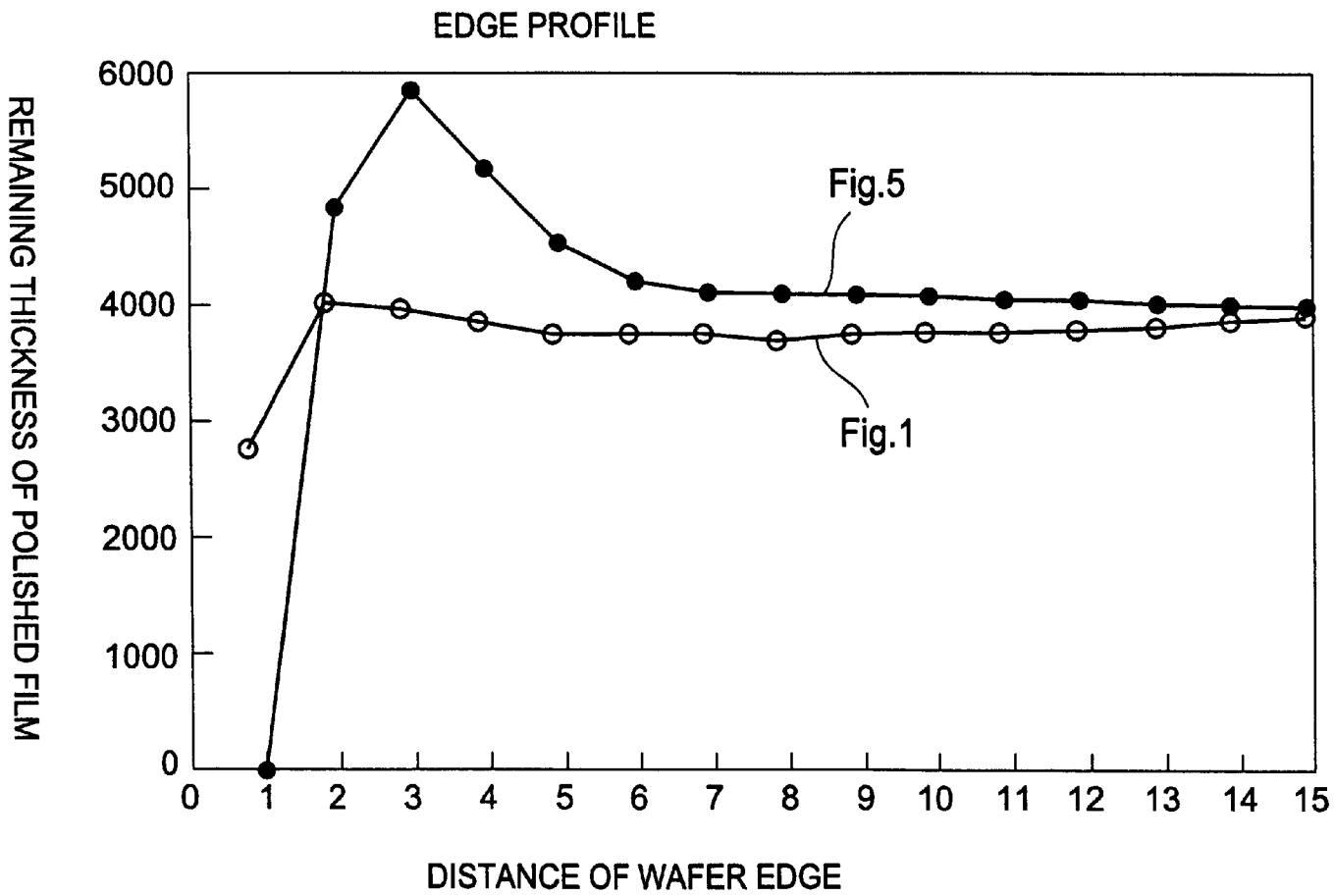
FIG. 9 shows the flatness of a surface of the wafer when the polishing surface of the polishing pad is pressed to the polishing pad by a mending unit of the present invention and when the conventional mending unit is used, respectively.

As shown in FIG. 1, the contact type mending unit 6 is arranged on the upstream side of the rotating direction of the polishing table 1. The mending unit 6 is supported by a support (not shown) provided on an area outside the area of the polishing table 1. With this mending unit 6, it is possible to shift a deformation, that is, the so-called rebound, of the polishing pad 4 from a peripheral position of the wafer 2 to a peripheral position of the mending unit 6. As mentioned, since the mending unit 6 is pressed to the polishing pad 4 in this manner, the desired flatness of surface is obtained in the outer peripheral portion of the wafer 2 as shown in FIG. 9. Therefore, the present invention can improve the yield of semiconductor wafer.

As mentioned above, since, in the present wafer polishing device, the mending unit 6 and the polishing pad 4 are in a strong contact with each other, no rebound occurs in the region of the polishing pad corresponding to the peripheral portion of the wafer 2. In addition, the slurry supply nozzle 11 is set at the point C such that the polishing slurry can be supplied not from a point A but from a point B, as shown in FIG. 1. According to this method, the polishing slurry drops from the slurry supply nozzle positioned at the point C and the dropped slurry is effectively taken in between the wafer 2 and the polishing pad 4. Therefore, the polishing slurry can be dispersed and supplied uniformly to the contact area between them.

In addition, the slurry trap 7 is provided on the downstream side surface of the polishing pad 4, as shown in FIG. 1. With this slurry trap 7, the polishing slurry newly dropped from the slurry supply nozzle to the point C is prevented from flowing out before it functions sufficiently and can be efficiently trapped in between the wafer 2 and the polishing pad 4.

The mending unit 6 is an embodiment of the polishing pad surface mending unit and its construction is not limited to the disclosed one in which the mending unit is supported separately from the retainer ring by the support provided on the area outside the area of the polishing table 1. For example, the mending unit may be supported by the retainer ring.

As described hereinbefore, according to the wafer polishing device of the present invention, the polishing pad surface mending unit for regulating the surface condition of the polishing pad while being in slide contact with the polishing pad is provided on the wafer on the upstream side of the rotating direction of the polishing table. Therefore, it is possible to disperse the concentrated load applied to the polishing pad through the wafer to thereby shift the rebound deformation of the polishing pad from the edge area of the wafer to the edge portion of the mending unit opposite to the edge area on the wafer. Therefore, it is possible to make the load distribution of the polishing pad and hence the wafer uniform. Further, since the polishing slurry is easily taken in between the polishing pad and the wafer with rotation of the spindle and the slurry trap is provided, the polishing slurry can be efficiently distributed and the uniformity of slurry distribution on the whole surface of the wafer is improved.

It is apparent from the aforementioned specification and the figures that the present invention is not limited to the above embodiments but may be modified and changed without departing from the scope and spirit of the invention.

What is claimed is:

1. A polishing device comprising:

a rotatable polishing table;

a polishing pad provided on said polishing table to polish a wafer;

a polishing slurry supply unit which supplies a polishing slurry onto a surface of said polishing pad; and a polishing pad surface mending unit arranged to be in slide contact with said polishing pad and surrounding a periphery of said wafer except a portion of said periphery so that a rebound deformation of said polishing pad is shifted from an edge of said wafer toward an edge of said polishing pad surface mending unit opposite to said edge of said wafer, wherein said portion of said periphery not surrounded by said polishing pad surface mending unit receives said polishing slurry.

2. The device as claimed in claim 1, wherein said polishing pad surface mending unit surrounds almost all of the periphery area of said wafer on an upstream side of said wafer in a rotating direction of said polishing table.

3. The device as claimed in claim 2, wherein a peripheral area of said wafer surrounded by said polishing pad surface mending unit is about 30% to 50% of a whole periphery of said wafer.

4. The device as claimed in claim 2, further comprising a slurry trap provided in a downstream side of said wafer in the rotating direction of said polishing table, for retaining the polishing slurry.

5. A polishing device comprising:

a rotatable polishing table;

a polishing pad provided on said polishing table for polishing a wafer;

a polishing pad surface mending unit arranged to be in slide contact with said polishing pad, said polishing pad surface mending unit only positioned on an upstream side of said wafer in a rotating direction of said polishing table and surrounding a peripheral area of said wafer to shift a rebound deformation of said polishing pad from an edge of said wafer toward an edge of said polishing pad mending unit opposite to said edge of wafer;

a polishing slurry supply unit which supplies a polishing slurry onto a surface of said polishing pad, said polishing slurry supply unit positioned at a peripheral area of said wafer which is not surrounded by said polishing pad surface mending unit to supply said polishing slurry through said periphery of said wafer not surrounded by said polishing pad surface mending unit to said wafer; and a slurry trap provided in a downstream side of said wafer in the rotating direction of said polishing table, for retaining the polishing slurry.

* * * * *